United States Patent [19]

Riffel et al.

[11] Patent Number: 4,556,046

[45] Date of Patent: Dec. 3, 1985

[54] HOOD FOR OVEN IN PIZZA DELIVERY VEHICLE

[75] Inventors: Leonard F. Riffel, Wichita; Ricardo Barrera, Rose Hill, both of Kans.

[73] Assignee: Pizza Hut, Inc., Wichita, Kans.

[21] Appl. No.: 599,496

[22] Filed: Apr. 12, 1984

[51] Int. Cl.[4] ..... F24C 15/20

[52] U.S. Cl. ..... 126/299 D; 55/356; 55/385 B; 55/473; 55/DIG. 36

[58] Field of Search ..... 55/356, 385 B, 473, 55/DIG. 36; 98/115 R, 116, 121 R; 126/299 R, 299 D

[56] References Cited

U.S. PATENT DOCUMENTS

| | | | |
|---|---|---|---|
| 2,664,808 | 1/1954 | Peterson | 126/299 D |
| 2,726,595 | 12/1955 | Jones et al. | 98/121 R |
| 3,064,551 | 11/1962 | Stalker | 126/299 D |
| 3,513,766 | 5/1970 | Ahlrich | 126/299 D |
| 3,530,784 | 9/1970 | Courchesne | 126/299 D |
| 3,589,266 | 6/1971 | Hike et al. | 126/299 D |
| 4,047,519 | 9/1977 | Nett | 126/299 D |
| 4,372,195 | 2/1985 | Dorius | 126/299 D X |

*Primary Examiner*—Harold Joyce

*Attorney, Agent, or Firm*—Willian, Brinks, Olds, Hofer Gilson & Lione, Ltd.

[57] ABSTRACT

A hood is provided for use over pizza ovens in pizza preparation and delivery vehicles. The hood comprises two intake air fans and one inline exhaust fan. The intake air fans are each disposed adjacent a side wall of the vehicle and direct air from the sides toward the center of the hood. The exhaust fan is disposed adjacent a back wall of the vehicle between the two intake air fans. The exhaust fan exhausts the air from which the vehicle. A back draft damper is disposed downstream the exhaust fan. Hinged louvers on the back draft damper can be adjusted with a threaded rod to balance the air flow within the system. Vents adjacent the intake air fans have fixed louvers shaped to impede water droplet flow from entering the vehicle.

22 Claims, 7 Drawing Figures

HOOD FOR OVEN IN PIZZA DELIVERY VEHICLE

BACKGROUND OF THE INVENTION

The present invention relates to a pizza oven hood.

In the past, pizza enthusiasts have generally found it necessary to leave their homes or places of work and travel to a pizza restaurant if they wanted a high quality fresh baked pizza. Although other methods of obtaining a pizza, such as purchasing a frozen pizza, cooking a fresh pizza from scratch or ordering a pizza for delivery, have been available for some time, these alternatives to visiting a restaurant are not without drawbacks. For example, frozen pizzas tend not to have the same high quality flavor and consistency as fresh pizzas, and of course, it is often inconvenient to bake a pizza from scratch. Further, ordering a pizza for delivery often results in disappointment for the pizza enthusiast. The delivered pizza is often lukewarm and soggy, and it may have lost flavor en route to the consumer.

Although the pizza industry has attempted to provide convenient delivery service to consumers, the problems attendant to traditional delivery systems may have limited the market. For example, it has been difficult or impossible to guarantee the quality of delivered pizzas because of the lack of control over the pizzas once they leave the restaurant.

Until recently, the concept of preparing and cooking pizza in a vehicle en route to delivery destination had not been seriously considered, perhaps at least in part because the difficulties presented by ventilating a pizza oven discouraged this approach. However, U.S. patent application Ser. No. 599,497 entitled *Pizza Preparation and Delivery System* and assigned to the assignee of the present invention, discloses a pizza delivery system in which a pizza can be prepared and cooked in a moving vehicle en route to a delivery destination.

In the past, pizzas have been cooked in restaurants or in residential dwellings, where ventilation could be provided by a variety of means. But traditional hood systems in a moving vehicle are not suitable for ventilating a pizza preparation and delivery vehicle for a variety of reasons.

One problem is attributed to space limitations. A pizza preparation and delivery vehicle should be as compact as possible, in order that energy costs can be maintained at reasonable levels. Nevertheless, space is required for preparing the pizzas, as well as for storing the pizza shells and the pizza topping ingredients. Thus, a compact pizza preparation and delivery vehicle lacks space for the ductwork normally associated with oven hoods.

Another problem relates to the external environment of the pizza preparation and delivery vehicle. Although traditional hoods have exhausting means in the roof or uppermost part of the hood, considerations of weather, bridge clearances and aesthetics militate against exhausting hood vapors through the top of the pizza preparation and delivery vehicle.

Yet another problem relates to the cost of operating the hood and conditioning the pizza preparation and delivery vehicle. It is particularly important in the vehicle to conserve conditioned air, because air conditioning places a large electrical load on the system. It would be extremely expensive to circulate all the conditioned air of the vehicle in order to obtain proper ventilation for the pizza oven therein.

SUMMARY OF THE INVENTION

The present invention is directed to a hood that has been particularly designed for use above a pizza oven in a moving vehicle.

According to this invention, a hood is provided in a pizza preparation and delivery vehicle having first and second opposed side walls and a back wall adjoining the side walls substantially at right angles thereto. First and second intake air vents are disposed at the respective first and second side walls. First and second intake air fans are positioned to draw air into the hood from the first and second intake air vents respectively. An exhaust fan is disposed between the first and second fans. The first and second intake air fans and the exhaust fan cooperate such that air is swept across the hood from the sides to the center thereof, and then the air is expelled out the back of the hood.

In a preferred embodiment, the air passes through first and second intake filters which are disposed respectively adjacent to the first and second intake fans. The intake filters are operative to filter air drawn into the hood by the fans as the air is directed inwardly toward the center of the hood from each of the side walls. Preferably, a full filter bank, comprised of one or more filters disposed upstream the exhaust fan, operates to filter any air passing through the exhaust fan. The filters cooperate to provide an even air flow across the depth of the hood.

Attendant objects and advantages of the invention will be apparent from the following detailed description read together with the drawings.

DETAILED DESCRIPTION OF THE PRESENTLY PREFERRED EMBODIMENTS

Figure 1:
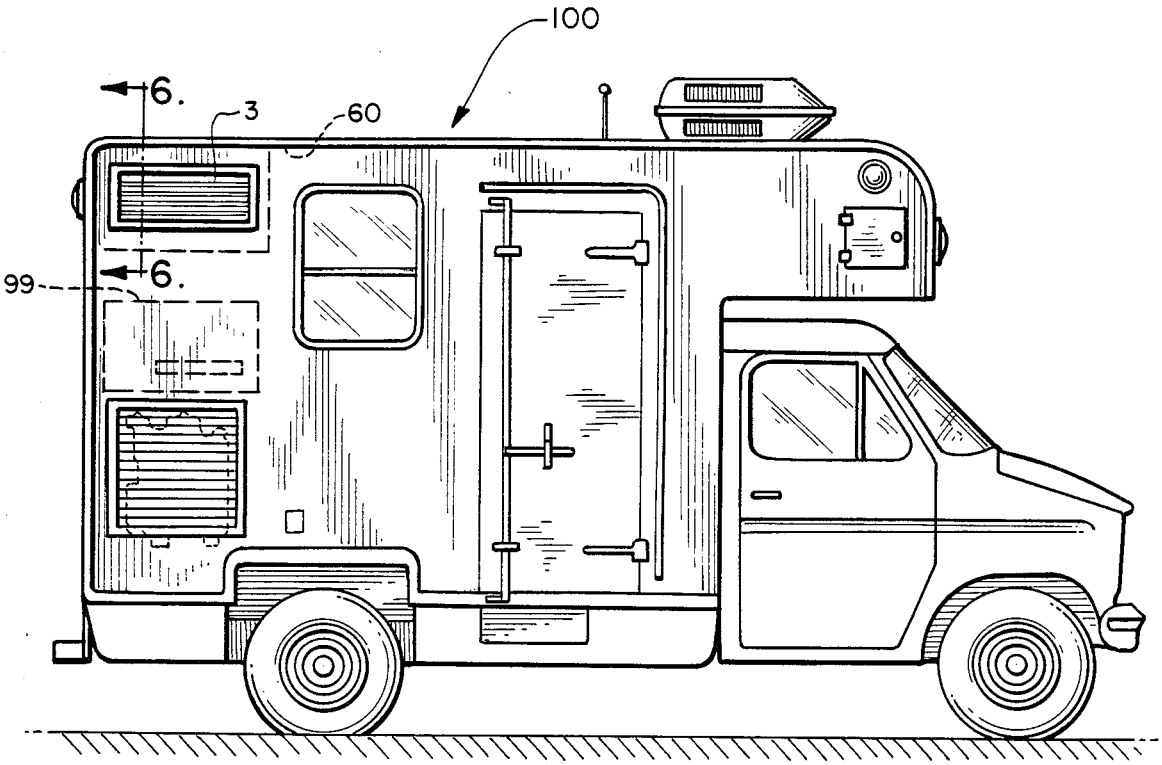
FIG. 1 is a side view of a pizza delivery vehicle containing the hood of the preferred embodiment of the present invention.
Figure 2:
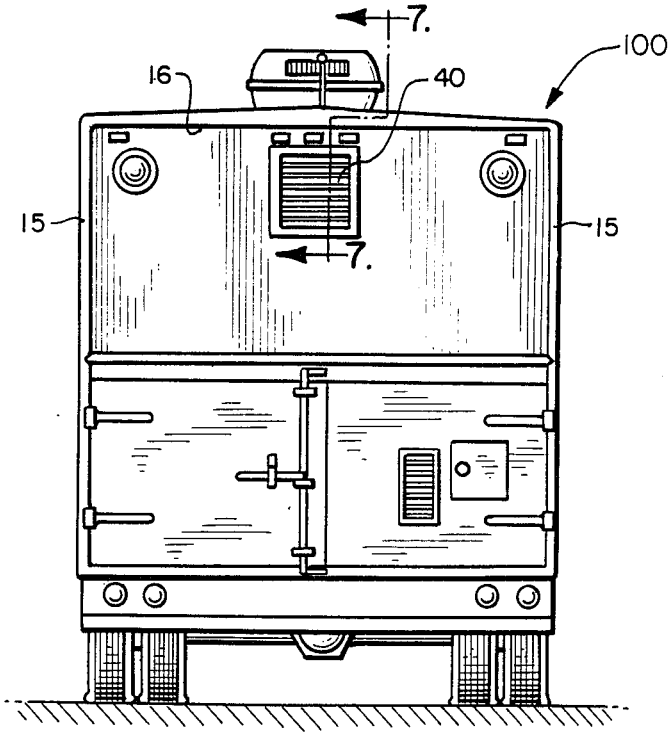
FIG. 2 is a rear view of the pizza delivery vehicle of FIG. 1.

Turning now to the drawings, FIGS. 1 and 2 show a pizza preparation and delivery vehicle 100 in which the hood 1 is mounted. The vehicle 100 includes two side walls 15, a back wall 16 and a ceiling 60. The hood is mounted in a housing 80 (see FIG. 3) in an upper portion of the vehicle 100 between the side walls 15, the back wall 16 and the ceiling 60. A pizza oven 99 is positioned in the vehicle 100 beneath the hood 1. It should be understood that the vehicle 100 and the oven 99 form no part of the present invention and are shown only to illustrate the environment in which the hood 1 is used.

Figure 3:
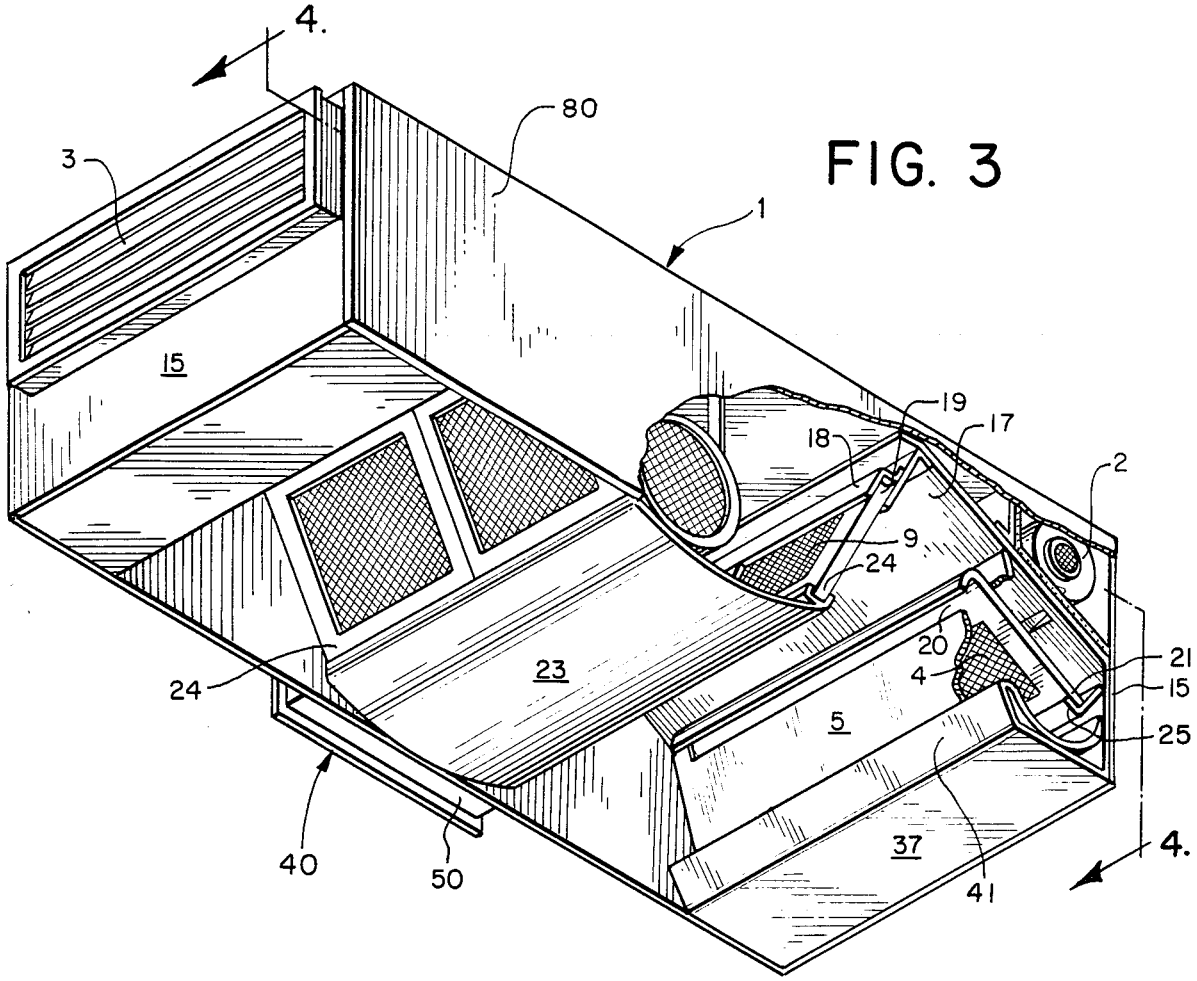
FIG. 3 is a perspective view from below the hood of the preferred embodiment of the present invention. in partial cutaway.
Figure 4:
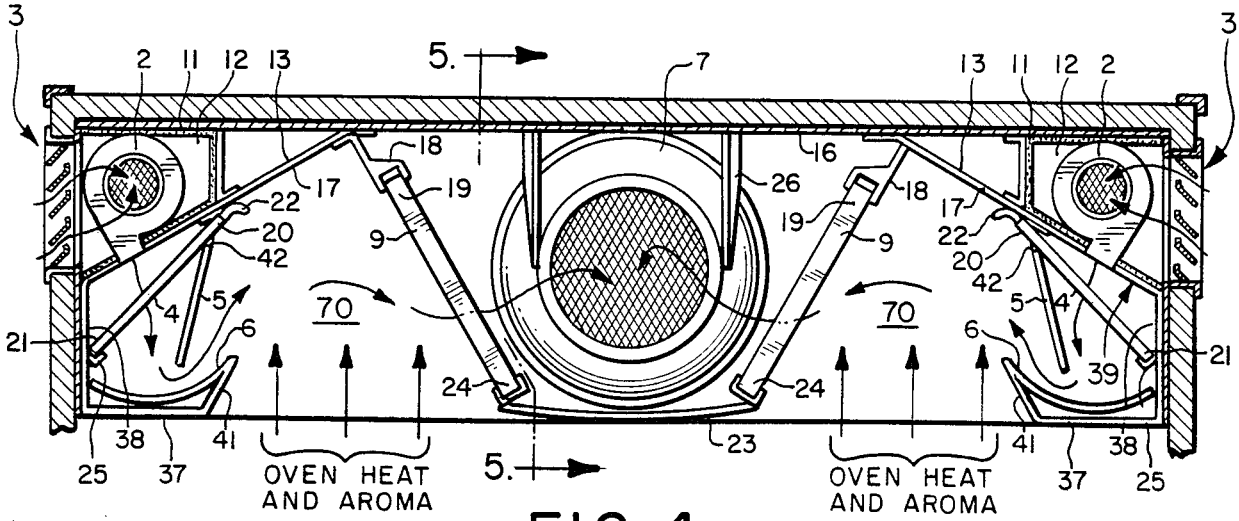
FIG. 4 is a longitudinal cross-sectional view, taken along line 4—4 of FIG. 3.
Figure 5:
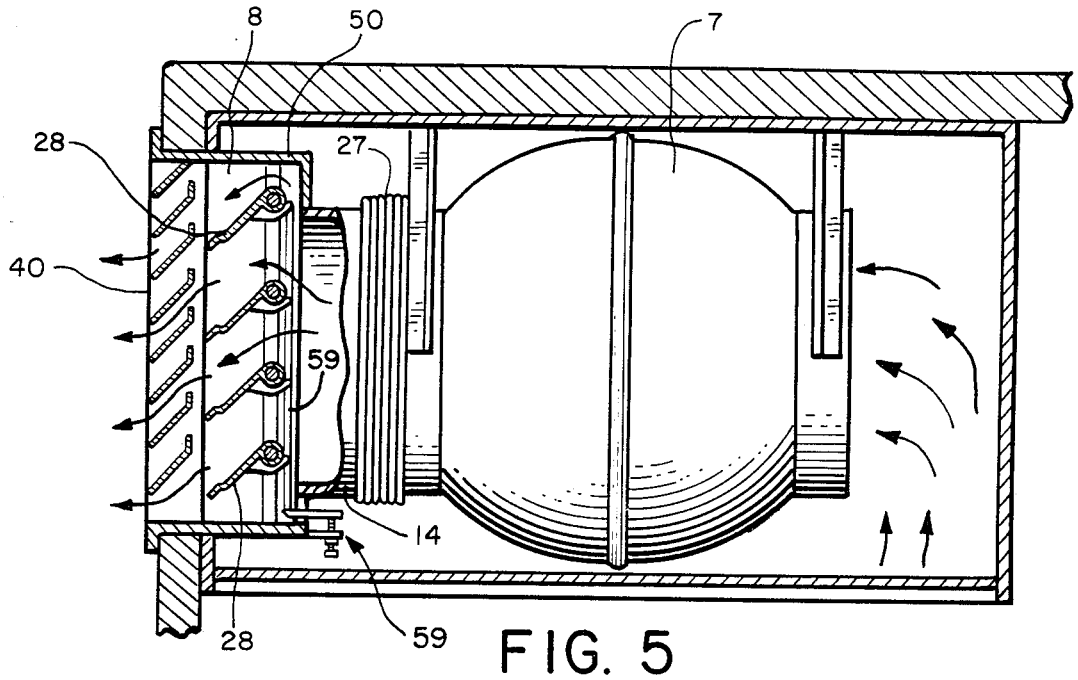
FIG. 5 is a transverse cross-sectional view taken along line 5—5 of FIG. 4.

FIGS. 3 through 5 show a presently preferred embodiment of the hood 1. The housing 80 defines two intake air vents 3 at respective side walls 15 and an exhaust vent 40 at the back wall 16 of the vehicle 100. Two intake air fans 2 are positioned to draw air through each of the respective intake air vents 3. The intake fans 2 are each disposed in a respective insulated intake air chamber 12. The intake chambers 12 are insulated with insulation 11 to reduce the migration of noise generated by fan motors, as well as to prevent condensation from forming on the walls of the intake chambers 12 and damaging the motors of the intake fans 2. Reinforcing panels 13 extend from the side walls 15 to the ceiling 16 of the vehicle 100, to give structural support to the intake air chambers 12. The reinforcing panels 13 are each preferably formed as part of a single body component 39 which includes a substantially vertical side portion 38 abutting the side wall 15, a substantially horizontal enclosure panel 37, an upwardly inclined flange 41 and a curved directing panel 6.

The air drawn into the vehicle 100 by the intake fans 2 is passed through respective intake filters 4. Then flat directing panels 5 and curved directing panels 6 direct the intake air from the side walls 15 of the vehicle 100 to two intermediate mixing zones 70. Heated oven air rises into the mixing zones 70 and is there mixed with the air from the intake fans 2. An inline exhaust fan 7 draws the air from the mixing zones 70 out through the exhaust vent 40 at the back wall 16 of the vehicle 100.

In the presently preferred embodiment, four exhaust filters 9 are disposed upstream of the exhaust fan 7. The exhaust filters 9 are supported by respective upper frames 18 and a lower frame 23, while the intake filters 4 are supported by the respective flat directing panels 5 and supporting brackets 25. The upper frames 18 are connected to a lower surface 17 of the reinforcing panels 13, and support upper ends 19 of exhaust filters 9. The flat directing panels 5 are also connected to the lower surface 17 of the reinforcing panels 13, and support upper ends 20 of the intake filters 4. An opening 42 in each of the flat directing panels 5 permits the upper end 20 of each of the intake filters 4 to pass through and be supported by the directing panels 5. The intake filters 4 each have a handle 22 attached to the upper ends 20 by which they can be removed from the hood 1 for cleaning and replacement. The lower frame 23 arcs below the exhaust fan 7 and supports the lower end 24 of each exhaust filter 9. The lower end 21 of each intake filter 4 is supported in a supporting bracket 25 which is connected to the vertical side portion 38 of the reinforcing panels 13.

Downstream the exhaust fan 7, a back draft damper 8 is provided in a housing 50. The back draft damper 8 includes a plurality of hinged louvers 28 which fall into a closed position when the exhaust fan 7 is not operating, to prevent a back draft from entering the vehicle 100.

An air balancing screw assembly 51 is provided to limit the degree to which the hinged louvers 28 can open. The balancing screw assembly 51 comprises a threaded rod 52 which is passed through a threaded bracket 53 abutting a lower section 54 of the back draft damper 8. The threaded rod 52 defines a stop surface 57 at its upper end. The threaded rod 52 is rotated to move the stop surface 57 up or down. Once the proper location of the stop surface 57 has been attained, a jam nut 56 is tightened to lock the threaded rod 52 and the stop surface 57 in place.

The hinged louvers 28 are connected to a connecting rod 59 via a plurality of pivotal linkages 58. The connecting rod 59 is in turn connected, for example by welding, to an angle foot bracket 66, or the connecting rod 59 can be formed integrally with the angle foot bracket 66. The connecting rod 59 and the angle foot bracket 66 are lowered as the hinged louvers 28 are pushed into an open position by the exhausted air. However, the angle foot bracket 66 is prevented from being lowered past the stop surface 57 defined by the threaded rod 52. In this manner, the degree to which the hinged louvers 28 can open is also limited.

Turning now to the details of the exhaust fan 7, a suspended bracket 26 which may be formed integrally with the exhaust fan 7 mounts the exhaust fan 7 in the hood 1. The exhaust fan 7 is also provided with a flex connection 27 which serves the function of isolating the exhaust fan vibrations and of accommodating slight misalignment between the exhaust fan 7 and the hood 1. A connection spacer 14 is disposed downstream of the flex connection 27 and is connected to the back draft damper housing 50.

Figure 6:
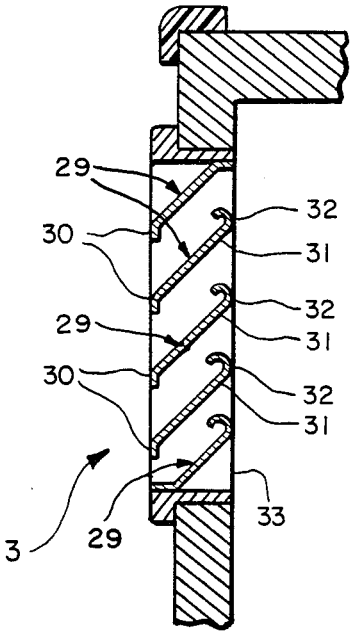
FIG. 6 is a cross-sectional view taken along line 6—6 of FIG. 1.
Figure 7:
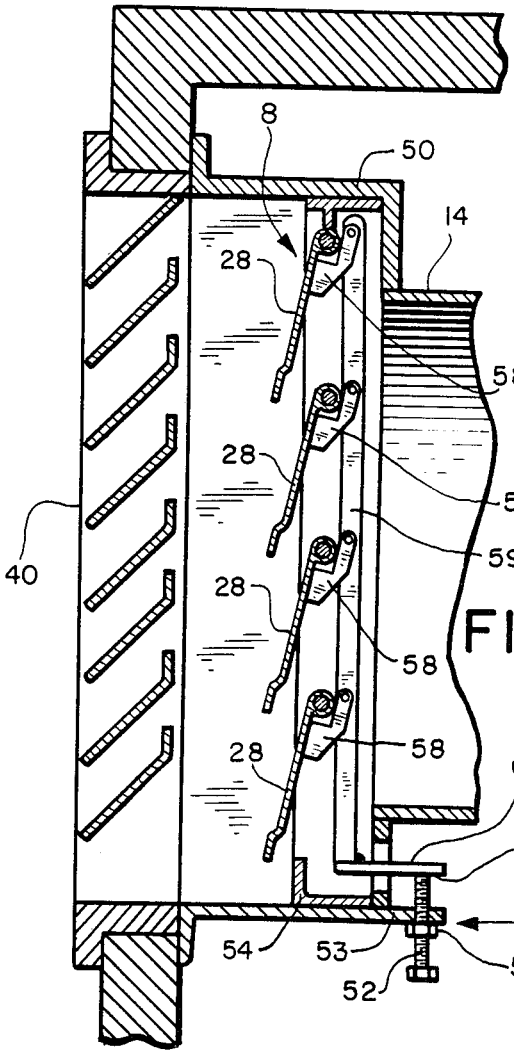
FIG. 7 is a cross-sectional view taken along line 7—7 of FIG. 2.

Another aspect of the present invention is related to the structure of the intake vents 3. As seen in FIG. 6, the intake vents 3 are provided with fixed louvers 29 shaped to impede the flow of water droplets from outside to inside the vehicle 100. In the presently preferred embodiment, each of the louvers 29 comprises an outer vertically disposed lower baffle 30, an intermediate upwardly inclined ramp section 31, and an innermost upwardly curved lip portion 32. Water droplets which ride up the ramp section 31 will fall back on the ramp section 31 from the curved lip portion 32, and thus will be prevented from entering the vehicle 100. Finally, it should be noted that in the preferred embodiment of the invention, the intake vents 3 are also provided with bird screens 33 disposed inwardly adjacent the fixed louvers 29.

The following details of construction are set forth only by way of example to define the preferred embodiment of this invention, and should not be considered to limit the scope of the invention. In this embodiment, the hood body components such as the directing panels 5 and 6, the reinforcing panels 13, the upper frames 18 and the lower frame 23 are preferably made from 16-gauge black iron. The lower frame 23 and the reinforcing panels 13 are tack welded with 1½ inch beads spaced 9 inches apart and have sealed joints. The insulation 11 for the intake air chamber 12 is a 1 inch thick duct liner glued in place. The intake filters 4 are preferably 14 inch by 13 inch by 1 inch filters with stainless steel fronts and aluminum mesh. Suitable filters can be obtained from George Evans Corp., 121 37th Street, Moline, Ill. 61265, as Model No. S5SR-1 or S5SR-2. The exhaust filters 9 are preferably 16 inches by 20 inches by 2 inches. These are removable and washable wire mesh filters with bail handles. Suitable filters are STANDARD KEIL TM filters obtainable from George Evans Corp. A suitable exhaust fan 7 is a Loren Cook Company 14CV Inline Exhaust Fan with a capacity to draw 800 cubic feet per minute at ⅝ of an inch static pressure and at 1140 RPM. It has a 0.25 horsepower motor and operates at 120 V. This fan is manufactured by Loren Cook Company and is marketed as catalog number 14CV11D by the distributor J. M. O'Connor, Inc., 811 E. Bayley, Wichita, Kans. 67201. The intake fans 2 are obtainable as Dayton 4C448A Blowers, each of which operate at 375 cubic feet per minute at ¼ inch static pressure and 120 V. Suitable intake fans 2 may be purchased from Dayton Electric Mfg. Co., 5959 West Howard Street, Chicago, Ill. 60648. A suitable back draft damper is obtainable from W. W. Grainger at 1920 South West Street, Wichita, Kans. 67213, as a Model BD2/Al 18 inch by 18 inch aluminum back draft damper. It has a 2 inch extruded aluminum frame, and formed blades with vinyl edge seals. This is also known as the DRAFT LOK TM damper, manufactured by PHL Inc., 621 Shady Retreat Road, Doylestown, Pa. 18901.

Now that the structure of the hood of the present invention has been described in some detail, the mode of operation will be discussed. Air is drawn in through the intake vents 3 at the side walls 15 of the vehicle 100 by the intake fans 2 in the intake air chambers 12. The air passes through the intake filters 4. The flat directing panels 5 and the curved directing panels 6 direct the flow of air to the two intermediate mixing zones 70. Air heated by the oven rises into the mixing zones 70 and is drawn with the intake air through the exhaust filters 9 and into the exhaust fan 7. The air from the mixing zones 70 is then exhausted from the vehicle 100 by the exhaust fan 7, via the back draft damper 8 and the exhaust vent 40.

The intake filters 4 and the exhaust filters 9 serve to evenly distribute the air flow across the hood 1. The filters create a resistance to air flow so that a substantially equal pressure is obtained in the regions (plenums) between the fans 2, 7 and the respective filters 4, 9.

The hood system is a balanced system, such that the air passing out the inline exhaust fan 7 is replaced by a substantially equal amount of make-up air. In the preferred embodiment, a slight negative pressure is maintained in the hood 1. The make-up air is primarily supplied by the intake air fans 2 such that about 90% to about 95% of the make-up air is untempered outside air drawn in by the intake fans 2, providing the advantage of energy conservation. The 5% to 10% remaining balance of make-up air is taken from the conditioned space outside the hood area. The system is balanced by adjustment of the hinged louvers 28 on the back draft damper 8. The balancing screw assembly 51 limits the degree to which the hinged louvers 28 can swing open. The hinged louvers 28 are preferably adjusted such that the system is either substantially perfectly balanced (i.e. no positive or negative pressure on the hood) or such that there is only a slight negative pressure in the hood. Balancing is accomplished by adjusting the balancing screw assembly 51 until only a very slight negative pressure is felt near a cracked open window or door of the vehicle 100.

The preferred embodiment of the hood 1 is particularly suitable for use over a conveyor oven (such as the Wear-Ever Impinger II TM, Model No. 1103, obtainable from Lincoln Manufacturing Co., 1111 North Hadley Road, Fort Wayne, Ind.), centrally positioned under the hood 1. The conveyor oven is open at its ends, where pizzas are inserted and removed. The heated oven air and the pizza aroma will rise from the open ends of the oven into the intermediate mixing zones 70 of the hood 1 between the directing panels 5 and exhaust filters 9, as shown in FIG. 4. This air will then flow, with the air from the intake fans 2, through the exhaust filters 9 and into the exhaust fan 7. It is noteworthy that in the presently preferred embodiment there will not be substantial heated oven air rising from the center of the conveyor oven, disposed under the lower frame 23, because this portion of the oven is not open to the hood.

The hood has several important advantages. First, it forms a single unit including all fans, so that cumbersome ductwork is not required. The compact structure of the hood saves space and energy. Further, bridge clearances will not present a problem since the fans are inside the hood.

Still further, the hood provides an easily adjustable air-balanced system. Thus, it permits a pizza oven to operate at full capacity in a pizza preparation and delivery vehicle without permitting the kitchen area of the vehicle to fill up with an excessive amount of heated oven air. An additional advantage is that the hood exhausts both the oven air and associated pizza aroma out of the vehicle, thereby advertising the pizza preparation and delivery system.

Yet another important advantage is the energy efficiency of the preferred hood. Untempered intake air comprises 90–95% of the make-up air required for maintenance of a balanced pressure system.

It should be understood that the present invention is not limited to the precise structure described above. Rather, a wide range of modifications can be made to this pizza oven hood without departing from the spirit of the invention. In addition, materials, details of construction, and dimensions can be varied as needed to suit individual applications. It is therefore intended that the foregoing detailed description be regarded as illustrative rather than limiting, and that it be understood that it is the following claims, including all equivalents, which are intended to define the scope of this invention.

We claim:

1. In a pizza preparation and delivery vehicle having first and second spaced side walls and a back wall adjoining said side walls and extending substantially perpendicular thereto, the improvement comprising:

a hood, comprising:

first and second intake air vents disposed at the respective first and second side walls of the vehicle such that air can be drawn from outside the vehicle to inside the vehicle through the first and second intake air vents;

first and second intake air fans positioned adjacent to the first and second intake air vents respectively and operative to draw air into the hood through the first and second intake air vents; and an exhaust fan positioned between said first and second intake air fans, operative to exhaust air out of the hood;

said first and second intake air fans and said exhaust fan cooperating to form an air flow from the first and second side walls and through the back wall of the vehicle.

2. The improvement of claim 1, further comprising a housing disposed in the vehicle between the first and second spaced side walls and the back wall, wherein:

the first and second intake air vents are defined by the housing;

the first and second intake air fans are mounted in the housing;

the exhaust fan is mounted centrally in the housing adjacent the back wall of the vehicle; and the housing defines an exhaust vent at the back wall of the vehicle, downstream the exhaust fan.

3. The improvement of claim 2, further comprising:

first and second intake air filters disposed downstream the respective first and second intake air fans and operative to form respective first and second intake air plenums between the respective first and second intake air fans and the respective first and second intake air filters;

at least one intermediate mixing zone disposed between the first and second intake air filters and the exhaust fan; and at least one exhaust filter panel disposed between the at least one intermediate mixing zone and the exhaust fan.

4. The improvement of claim 3, further comprising:

means for directing the air drawn into the hood by the first and second intake air fans to the at least one intermediate mixing zone.

5. The improvement of claim 4 wherein the means for directing the air drawn into the hood by the first and second intake air fans comprises first and second upwardly curved directing panels, defined by the housing adjacent the first and second side walls of the vehicle, and disposed downstream the respective first and second intake air plenums.

6. The improvement of claim 1 wherein the first and second intake air vents each comprise a plurality of fixed louvers, each of said louvers having an upwardly inclined ramp section and an upwardly curved lip integral with the upwardly inclined ramp section, such that each of said plurality of fixed louvers are operative to impede water droplet flow from outside the vehicle.

7. The improvement of claim 2, further comprising a back draft damper defined by the exhaust vent, which damper comprises a plurality of hinged louvers.

8. The improvement of claim 7 wherein the back draft damper comprises a plurality of hinged louvers.

9. The improvement of claim 7 further comprising adjustment means to limit opening movement of the hinged louvers such that an air flow rate is established in cooperation with the first and second intake air fans such that about 90 to about 95% of the exhausted air comprises air drawn into the hood by the first and second intake air fans.

10. In a pizza preparation and delivery vehicle having first and second spaced side walls and a back wall adjoining said side walls and extending substantially perpendicular thereto, the improvement comprising:

a hood, comprising:

a housing disposed in the vehicle between the first and second spaced side walls and the back wall;

first and second intake air vents disposed respectively adjacent the first and second side walls and defined by the housing;

first and second intake air fans mounted in the housing and disposed adjacent the first and second respective intake air vents, said first and second intake air fans operative to draw air from outside the vehicle to inside the housing;

first and second intake air filters mounted in the housing and disposed downstream the respective first and second intake air fans, operative to form respective first and second intake air plenums between the respective first and second intake air fans and the respective first and second intake air filters;

an exhaust vent disposed adjacent the back wall and defined by the housing;

an exhaust fan, centrally disposed in the housing between the first and second intake air fans, operative to exhaust air through the exhaust vent from inside the hood to outside the hood;

at least one exhaust filter panel, disposed upstream the exhaust fan, operative to form an exhaust plenum between the at least one exhaust filter panel and the exhaust fan;

at least one intermediate mixing zone disposed between the first and second intake air plenums and the exhaust plenum;

first and second directing panels, disposed downstream and adjacent the respective first and second intake air plenums, operative to direct air drawn into the hood by the respective first and second intake air fans into the at least one intermediate mixing zone;

said first and second intake air vents, said first and second intake air fans, said first and second intake air filters, said first and second directing panels, said at least one intermediate mixing zone, said at least one exhaust filter panel, said exhaust fan and said exhaust vent cooperating to draw air across the hood from the side walls of the vehicle and to exhaust the air, along with additional heated oven air, through the back wall of the vehicle.

11. A hood for ventilating a pizza oven in a pizza preparation and delivery vehicle, said hood comprising:

a housing including first and second spaced side walls disposed at respective first and second sides of the hood, a rear portion adjoining said side walls and extending substantially perpendicular thereto, said housing partially enclosing at least one intermediate mixing zone disposed between the side walls;

first and second intake air vents defined by the first and second side walls respectively;

first and second intake air fans positioned to draw air from the first and second intake air vents, each of said fans operative to direct air in an inward direction from each of the side walls to the at least one intermediate mixing zone;

an exhaust fan, disposed adjacent the rear portion of the housing, operative to exhaust air from the at least one intermediate mixing zone inside the hood to outside the hood; and an exhaust vent, disposed downstream the exhaust fan, through which air is exhausted by the exhaust fan;

said first and second intake air fans and said exhaust fan cooperating to draw air from the first and second sides of the hood, to direct the air to the at least one intermediate mixing zone of the hood, and to exhaust said air from the at least one intermediate mixing zone of the hood through the exhaust vent.

12. The invention of claim 11, further comprising:

first and second intake air filters, disposed respectively adjacent the first and second intake fans, operative to filter air directed by said fans as said air is directed in an inward direction from each of the side walls to the at least one intermediate mixing zone; and at least one exhaust filter, disposed upstream the exhaust fan, operative to filter any air passing through said said filter and into the exhaust fan.

13. The invention of claim 11, further comprising first and second insulated intake chambers disposed adjacent the intake air vents for housing the first and second intake air fans respectively.

14. The invention of claim 11 wherein said first and second intake air vents each include a plurality of fixed louvers each having an upwardly inclined ramp section and an upwardly curved lip integral with the upwardly inclined ramp section, wherein said plurality of fixed louvers are operative to impede water droplet flow from outside to inside the hood.

15. The invention of claim 11 further comprising means for adjusting air flow rate such that about 90 to about 95% of the exhausted air comprises air drawn in by the first and second intake air fans.

16. The invention of claim 11, further comprising a back draft damper having hinged louvers disposed downstream of the exhaust fan.

17. The invention of claim 16, further comprising adjustment means to limit opening movement of the hinged louvers.

18. A hood for ventilating a conveyor oven in a pizza preparation and delivery vehicle said hood comprising:

a housing having first and second opposed side walls and a back wall adjoining and substantially at right angles to said side walls;

first and second intake air vents, defined by the first and second side walls respectively;

first and second intake air fans, mounted in the housing, respectively adjacent the first and second intake air vents, operative to draw air from outside the vehicle to inside the vehicle, and to direct the air in an inward direction from the first and second side walls to respective first and second intermediate mixing zones;

first and second intake air filters mounted in the housing, disposed respectively downstream the first and second intake air fans, operative to form a first and second plenum between respective first and second intake air fans and intake air filters upstream the respective first and second intermediate mixing zones;

an exhaust fan having a first side facing the first side wall and a second side facing the second side wall, disposed centrally in the housing adjacent the back wall and operative to exhaust air from inside the vehicle to outside the vehicle; and first and second exhaust filters, disposed upstream the exhaust fan adjacent to respective first and second sides thereof and downstream the respective first and second intermediate mixing zones, operative to filter the air directed to the respective first and second intermediate mixing zones by the respective first and second intake air fans along with additional air rising into the first and second intermediate mixing zones from the conveyor oven.

19. The invention of claim 18, further comprising a plurality of fixed louvers defined by each of the first and second intake air vents, each fixed louver having an outer substantially vertically disposed baffle, an intermediate inclined ramp section and an inner upwardly curved lip such that water droplet flow will be substantially prevented from entering the vehicle through the first and second intake air vents.

20. The invention of claim 19, further comprising a back draft damper disposed downstream the exhaust fan.

21. The invention of claim 20, further comprising a plurality of adjustable hinged louvers, defined by the back draft damper, for controlling air flow through the back draft damper to thereby adjust the ratio between the air which has been drawn through the intake air fans and the total amount of air exhausted.

22. The invention of claim 21 wherein the ratio is about 9 to 10.

* * * * *